US006347704B1

(12) United States Patent
Dixon

(10) Patent No.: US 6,347,704 B1
(45) Date of Patent: Feb. 19, 2002

(54) CARTON WITH SUPPLEMENTAL INFORMATION PANEL

(75) Inventor: Rodney D. Dixon, Burlington, NC (US)

(73) Assignee: MPC Packaging Corporation, Mebane, NC (US)

( * ) Notice: Subject to any disclaimer, the term of this patent is extended or adjusted under 35 U.S.C. 154(b) by 0 days.

(21) Appl. No.: 09/580,763

(22) Filed: May 30, 2000

(51) Int. Cl.[7] ..... B65D 5/10
(52) U.S. Cl. ..... 206/459.5; 206/831; 206/232
(58) Field of Search ..... 206/831, 459.5, 206/232; 40/312

(56) References Cited

U.S. PATENT DOCUMENTS

| | | | | |
|---|---|---|---|---|
| 2,296,556 A | * | 9/1942 | Junkin | 229/143 |
| 3,062,430 A | | 11/1962 | Rutledge | 229/37 |
| 3,099,381 A | | 7/1963 | Meyers | 229/37 |
| 3,214,075 A | | 10/1965 | Champlin et al. | 229/16 |
| 3,335,937 A | | 8/1967 | Kramer | 229/38 |
| 3,606,135 A | | 9/1971 | Rosenburg, Jr. | 229/37 |
| 4,103,820 A | | 8/1978 | Mathison et al. | 229/37 R |
| 4,108,350 A | | 8/1978 | Forbes, Jr. | 229/37 R |
| 4,320,830 A | | 3/1982 | Roccaforte | 206/45.19 |
| 4,344,533 A | | 8/1982 | Olsen | 206/459 |
| 4,834,240 A | | 5/1989 | Dagostine | 206/459 |
| 4,838,424 A | * | 6/1989 | Petzelt | 206/459.5 |
| 4,872,555 A | | 10/1989 | Shadrach III et al. | 206/459 |
| 4,949,845 A | | 8/1990 | Dixon | 206/626 |
| 5,072,877 A | | 12/1991 | Van Fulpen | 229/155 |
| 5,074,462 A | | 12/1991 | Countee, Jr. | 229/155 |
| 5,082,113 A | | 1/1992 | Romick | 206/459 |
| 5,341,923 A | | 8/1994 | Arasim | 206/214 |
| 5,363,955 A | * | 11/1994 | Fleenor | 206/273 |
| 5,697,549 A | | 12/1997 | Yocum | 229/400 |

FOREIGN PATENT DOCUMENTS

WO WO 97/19860 * 6/1997

* cited by examiner

*Primary Examiner*—Paul T. Sewell
*Assistant Examiner*—Troy Arnold
(74) *Attorney, Agent, or Firm*—Womble Carlyle Sanderlaye & Rice, PLLC; C. Robert Rhodes

(57) ABSTRACT

A carton for packaging articles, having at least one supplemental information panel hingedly connected to one of the wall panels. The supplemental information panel is disposed inside the carton and can be withdrawn through an end of the carton.

8 Claims, 2 Drawing Sheets

CARTON WITH SUPPLEMENTAL INFORMATION PANEL

BACKGROUND OF THE INVENTION

The present invention relates generally to folding cartons and, more particularly, to a folding carton having at least one supplemental information panel providing additional space for the printing of indicia thereon.

For many years, manufacturers have packaged products of many types and sizes in paperboard cartons. For items manufactured and packaged for resale, manufacturers often utilize the surfaces of the cartons for distinctive, catchy advertising, intended to induce consumers to purchase the product. As consumer product and product liability standards have evolved in recent decades, manufacturers have been required to print increasing amounts of consumer protection information directly on the outside of cartons, or in the alternative, on paper inserts placed in the cartons with the product. Further, many regulatory warnings are now required to be of a particular type or size. This has increased the need for printing area, whether on the outside of cartons or on the paper inserts packaged with the product. While printed paper inserts are relatively inexpensive to produce, considerable difficulty is involved in folding the inserts and placing them in the cartons. There is also considerable effort and expense involved in making sure the correct insert is placed in the corresponding package, as a mistake can have extremely bad consequences. Also, quite often, after purchase consumers never remove the inserts from the cartons, simply discard them, or they otherwise become removed from the carton.

The prior art discloses cartons having an additional separable panel directed to providing recipes or coupons. The additional panel may not be reattached, and is permanently separated from the carton. There is further known a one-piece carton having an integral coupon card in a side panel that may be detached from the carton along a perforated line, but the construction of the carton and coupon is not directed to additional printing area and cannot be returned to its original configuration once opened. There are also known in the art cartons having fifth panels for supporting the cartons from displays or for use as closure flaps once the cartons have been initially opened by means of removable tear strips or the like.

SUMMARY OF THE INVENTION

The present invention is directed to a carton for packaging articles wherein at least one supplemental information panel provides substantially more printing space for instructions, consumer information, or regulatory warnings. The present invention provides such a carton whereby a purchaser can access and view instructions, information, and warnings without destructively altering the carton. Thus the carton is still usable with the information intact.

Accordingly, one aspect of the present invention is to provide a carton for packaging articles that includes an integrally-formed supplemental information panel in addition to coated walls such that printing, images, or other indicia may be printed on each of the outer surfaces and on the information panel. Desirably, all outer surfaces, as well as the additional panels, are coated with a water-soluble silicon based coating suitable for printing thereon and sufficiently heat resistant to withstand printing. One such coating is manufactured by Kelstar Enterprises, Inc. as Item ACC222.

To provide additional printing surface area, at least one supplemental information panel is connected to the inside surface of one of the carton wall panels. At least one of the surfaces of this supplemental information panel is coated for printing. The information panel can be formed of two or more individual panels that are connected together in series and folded one upon the other with at least one surface coated to receive additional print media thereon. The information panel so formed can be folded over and disposed within the end of the carton when the carton is being shipped, stored, or displayed for sale to consumers. Desirably, the extended information panel of the present invention is formed from two or more connected panels that are attached in hinge-like fashion to each other and to the inner surface or edge of a wall panel. The panels are folded one upon the other to form a single information panel of a size slightly smaller than the end closure panel such that the information panel can be extensibly withdrawn from the end of the carton. Once a consumer item, such as a pharmaceutical, has been placed in the carton, the supplemental information panel is disposed within the carton. Alternatively, the supplemental information panel may be folded and adhered to the inner surface of the wall panel to which it is hingedly connected before the item is placed in the carton.

Another aspect of the present invention is to provide a single blank for folding into a carton and having a plurality of adjacent wall panels, a supplemental information panel, and end closure panels. The blank is comprised of multiple rectangular panels. A coating is conventionally provided on one surface of the blank for printing, images, or other indicia. The box is so folded that the coated side forms the exterior of the box and the uncoated side forms the interior of the box.

These and other aspects of the present invention will become apparent to those skilled in the art after a reading of the following description of the preferred embodiment when considered with the drawings.

DESCRIPTION OF THE PREFERRED EMBODIMENTS

Figure 1:
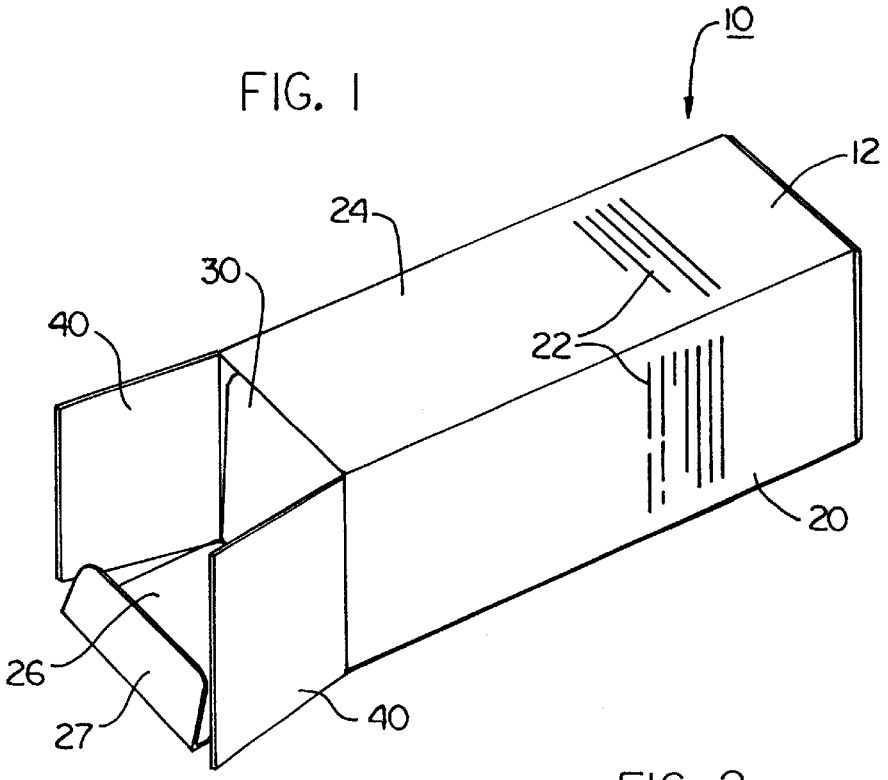
FIG. 1 is a front perspective view of a carton constructed according to the present invention showing the supplemental information panel disposed inside one end of the carton.
Figure 3:
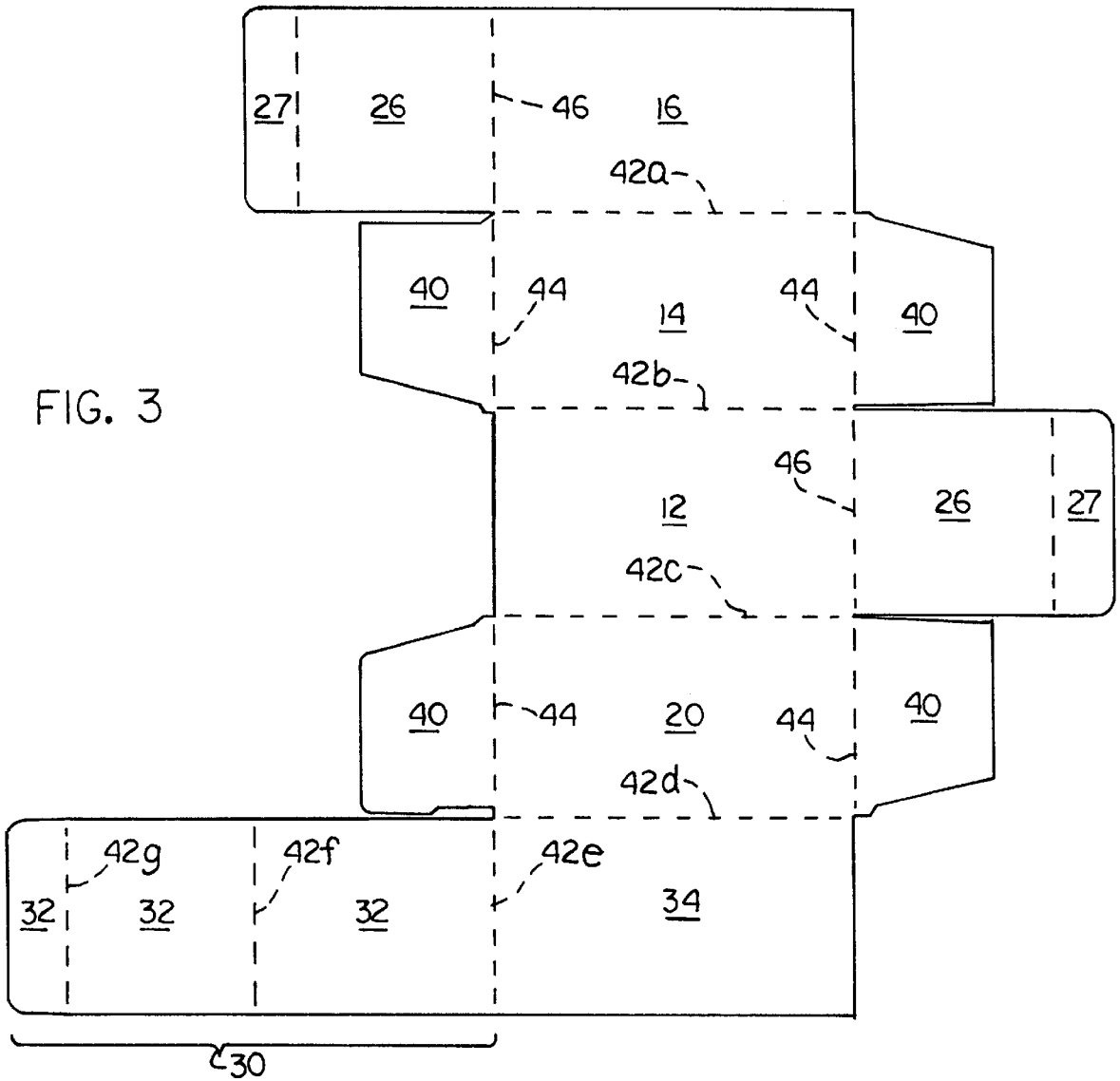
FIG. 3 is a plan view of a blank foldable sheet material from which a carton constructed according to the present invention may be formed.

Referring now to the drawings in general and FIG. 1 in particular, it will be understood that the illustrations are for the purpose of describing a preferred embodiment of the invention and are not intended to limit the invention thereto. As best seen in FIGS. 1 and 3, a carton constructed according to the present invention, generally designated 10, includes wall panels 12, 14, 16, and 20, all hingedly connected along fold lines. The carton 10 may be formed from a unitary blank of foldable sheet material such as paperboard where the weight of the paperboard used in the construction of carton 10 is dependent upon the weight of the articles being packaged. Desirably, one complete surface of the sheet material is coated such that printing, images, and other indicia 22 may be applied thereto. The coating is conventionally a water-soluble silicon based material or other coating material that is suitable for printing thereon and sufficiently heat resistant to withstand printing and hot glue adhesion. One such coating is manufactured by Kelstar Enterprises, Inc. as Item ACC222.

Turning now to FIGS. 1 and 3, the preferred embodiment of carton 10 includes an end closure panel 26 with tuck flap 27 hingedly connected on one end to wall panel 12 and on the other end to wall panel 16. Upon placing an article in the carton 10, end closure panels 26 may be folded down over the open end of the carton and secured closed with tuck flap 27 that is inserted adjacent the inner surface of wall panel 12 or 16.

Figure 2:
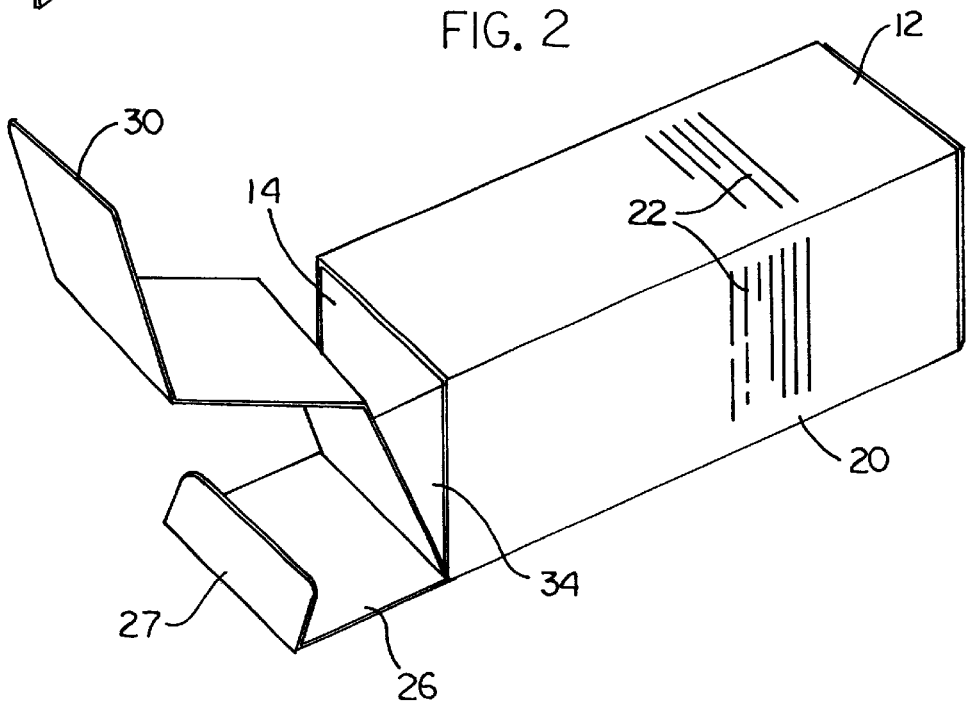
FIG. 2 is a front perspective view similar to FIG. 1 except illustrating the supplemental information panel in the withdrawn position.

As best seen in FIGS. 2 and 3, depending upon the article to be packaged, it may be desirable to employ closure tabs 40 in addition to end closure panels 26. The closure tabs 40 are substantially the same size and may be hingedly connected to the ends of wall panels 14 and 20. Closure tabs 40 are folded inward over the end opening of carton 10 before end closure panels 26 are folded inward and secured.

The configuration of walls 12, 14, 16, and 20, closure panels 26, and closure tabs 40 is conventional. The present invention adds to the above construction a supplemental information panel 30 sized to be extensibly withdrawn through the end of carton 10. As best seen in FIGS. 1 and 2, a supplemental information panel 30 is desirably comprised of at least two panels 32 hingedly connected together along fold lines, whereby supplemental panel 30 is then hingedly connected to an interior surface or edge of carton 10. Supplemental information panel 30 may be foldably disposed within carton 10, or in the alternative, panels 32 may be releasably adhered one upon the other and disposed with carton 10 or folded one upon the other in accordion fashion and disposed within carton 10. As best seen in FIG. 3, carton 10 may include at least one interior panel 34 integrally formed with carton 10 and adhered to wall panel 16. Where interior panel 34 is included, supplemental information panel 30 may be hingedly attached along a fold line or tear line to interior panel 34. Alternatively, panel 34 may be separately formed. In such case, panel 34 could be smaller and easily adhered to the inside surface of any one of wall panels 12, 14, 16, or 20.

Turning now to FIG. 3, the blank forming a carton constructed to the present invention is shown. As can be seen, the blank is in the form of a single planar unitary sheet of cardboard or paperboard in which one surface is coated and printed. The main body of the carton is formed from four substantially rectangular panels 12, 14, 16, and 20. These panels are linked to each other by means of horizontal folding lines 42*a*, 42*b*, and 42*c* which facilitate folding of the carton panels relative to each other. Each of panels 14 and 20 is provided with a pair of closure tabs 40 connected along respective transverse edges by means of corresponding score lines 44. Similarly, each of panels 12 and 16 is provided with a closure panel 26 hingedly attached along fold lines 46 such that the closure panel 26 attached to wall panel 16 is at the opposite end of the carton 10 from the closure panel 26 attached to wall panel 12.

In forming a carton from the blank according to the present invention, wall 16 and wall 14 are formed by folding rectangular panels along fold line 42*a*. Likewise, walls 16 and 20 are formed by folding the blank panels along fold lines 42*b* and 42*c*. Closure of the carton is accomplished by folding panel 34 inward along fold line 42*d* and adhering panel 34 to the inner surface of panel 16.

Supplemental information panel 30 is formed of adjacent panels 32 that are hingedly connected together and extend upward from fold line 42*e* on panel 34. Panels 32 are folded one upon the other along fold lines 42*f* and 42*g*. At least one surface of panels 32 is coated for the printing of indicia thereon. Once formed, supplemental information panel 30 is disposed within carton 10 near the end (FIG. 1) and can be extended through the end of carton 10 (FIG. 2). Where panel 34 is separately formed, the blank will not include panel 34 or supplemental information panel 30. In that case, panel 34 with attached supplemental information panel 30 can be adhered to any one of wall panels 12, 14, 16, or 20 either during or after the formation of carton 10 from the blank.

Closure of carton 10 is achieved by first folding information panel 30 and disposing it within the carton adjacent wall panel 34. Closure tabs 40 are then folded inwardly along fold lines 44 and end closure panels 26 are folded inward along fold lines 46 and tuck flaps 27 are inserted into the carton adjacent to wall panels 12 and 16. Alternatively, closure tabs 40 could be folded inwardly first and then information panel 30 could be folded and disposed atop tabs 40 and beneath closure panel 26.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A carton for packaging an item, said carton comprising:

(a) a plurality of wall panels of substantially equal length, each of said wall panels having first and second end edges and side edges;

coated outer surfaces for printing thereon;

wherein said wall panels are connected together along said side edges to form corners;

(b) at least one supplemental information panel having at least one surface for printing thereon and connected to at least one of said wall panels along one of said end edges; and (c) said at least one supplemental information panel being formed of at least two sub-panels, the length of any sub-panel being no greater than the corresponding dimension of the adjacent wall panel end edge, the sub-panels being foldably disposed one upon the other and positionable within said carton such that said information panel is extendable from an opened end of said carton.

2. The carton of claim 1 wherein one of said wall panels forms an interior panel having end edges, said interior panel adhered to one of said wall panels to form said carton.

3. The carton of claim 1 further including end closure panels hingedly connected to at least one said wall panel first end edge and to at least one said wall panel second end edge.

4. The carton of claim 2 wherein said at least one supplemental information panel is hingedly attached to an end edge of said interior panel and extends outwardly therefrom through the end of said carton.

5. A blank for folding into a carton, said blank comprising:

(a) a plurality of wall panels, all of which are substantially the same length, and which are hingedly connected together along side edges, said panels having end edges; and (b) at least one supplemental information panel formed of at least two hingedly connected sub-panels extending outwardly from and hingedly connected to at least one end edge of at least one wall panel, the length of any sub-panel being no greater than the corresponding dimension of the adjacent wall panel end edge.

6. The blank of claim 5 wherein one of said plurality of wall panels forms an interior wall panel having end edges, said interior panel being hingedly connected to a side edge of another one of said wall panels and capable of underlying and being adhered to one of said wall panels to form said carton.

7. The blank of claim 5 wherein at least one of said wall panel end edges at each end of said carton is provided with a closure panel hingedly secured thereto.

8. The blank of claim 5 further comprising a coating on at least one surface thereof for printing.

* * * * *